US009279567B2

(12) United States Patent
Hu et al.

(10) Patent No.: US 9,279,567 B2
(45) Date of Patent: Mar. 8, 2016

(54) LENS HAVING TOTAL REFLECTIVE SIDE SURFACES AND LIGHT SOURCE MODULE WITH SAME

(71) Applicant: HON HAI PRECISION INDUSTRY CO., LTD., New Taipei (TW)

(72) Inventors: Chau-Jin Hu, New Taipei (TW); Feng-Yuen Dai, New Taipei (TW); Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 194 days.

(21) Appl. No.: 13/975,354

(22) Filed: Aug. 25, 2013

(65) Prior Publication Data

US 2015/0043218 A1 Feb. 12, 2015

(30) Foreign Application Priority Data

Aug. 8, 2013 (TW) ..... 102128425 A

(51) Int. Cl.

| | |
|---|---|
| ***F21V 3/00*** | (2015.01) |
| ***F21V 13/04*** | (2006.01) |
| ***F21K 99/00*** | (2010.01) |
| ***F21V 5/04*** | (2006.01) |
| *F21Y 101/02* | (2006.01) |

(52) U.S. Cl.
CPC . *F21V 13/04* (2013.01); *F21K 9/50* (2013.01); *F21V 5/04* (2013.01); *F21Y 2101/02* (2013.01)

(58) Field of Classification Search
CPC ..... F21V 5/04; F21V 13/04
USPC ..... 362/311.02
See application file for complete search history.

(56) References Cited

U.S. PATENT DOCUMENTS

| | | | | |
|---|---|---|---|---|
| 7,798,679 | B2 * | 9/2010 | Kokubo et al. | 362/335 |
| 8,052,307 | B2 * | 11/2011 | Bak et al. | 362/257 |
| 2009/0052192 | A1 * | 2/2009 | Kokubo et al. | 362/311.09 |

* cited by examiner

*Primary Examiner* — Anh Mai
*Assistant Examiner* — Hana Featherly
(74) *Attorney, Agent, or Firm* — Novak Druce Connolly Bove + Quigg LLP

(57) ABSTRACT

The present disclose relates to a lens. The lens includes a bottom surface; a light input surface depressed from a center of the bottom surface; a light output surface opposite to the light input surface, the light output surface comprising a concave surface located at a center thereof and a convex surface surrounding the concave surface; and total reflective side surfaces. The side surface includes a first and a second side surfaces gradually slanting outwardly along a direction from the bottom surface to the light output surface, and a third side surface and a fourth side surface being perpendicular to the bottom surface. The present disclose also relates to a light source module with the lens.

18 Claims, 6 Drawing Sheets

LENS HAVING TOTAL REFLECTIVE SIDE SURFACES AND LIGHT SOURCE MODULE WITH SAME

BACKGROUND

1. Technical Field

The disclosure relates to a lens and a light source module with the lens.

2. Discussion of Related Art

Light emitting diodes (LEDs) with many advantages, such as high luminosity, low operational voltage, low power consumption, compatibility with integrated circuits, faster switching, long term reliability, and environmental friendliness have promoted their wide use as a lighting source.

Conventional tubular light source module includes a substrate and a plurality of LEDs arranged on the substrate in line. However, the LED generally generates a small spot with a radiation angle less than 120 degrees. The intensity of light emitted by the LEDs is concentrated, wherein the light intensity dramatically decreases when the radiation angle exceeds 120 degrees. The distribution of light emission of the conventional tubular light source is uneven when the LEDs are arranged sparsely. Therefore, it needs a plurality of LEDs arranged in line closely in order to achieve even light distribution. However, use of so many LEDs is costly.

Therefore, what is needed is a lens and a light source module with the lens which can overcome the described limitations.

BRIEF DESCRIPTION OF THE DRAWINGS

Many aspects of the disclosure can be better understood with reference to the following drawing. The components in the drawing are not necessarily drawn to scale, the emphasis instead being placed upon clearly illustrating the principles of the present light emitting diode device for microminiaturization. Moreover, in the drawing, like reference numerals designate corresponding parts throughout the whole view.

DETAILED DESCRIPTION OF EMBODIMENTS

Figure 1:
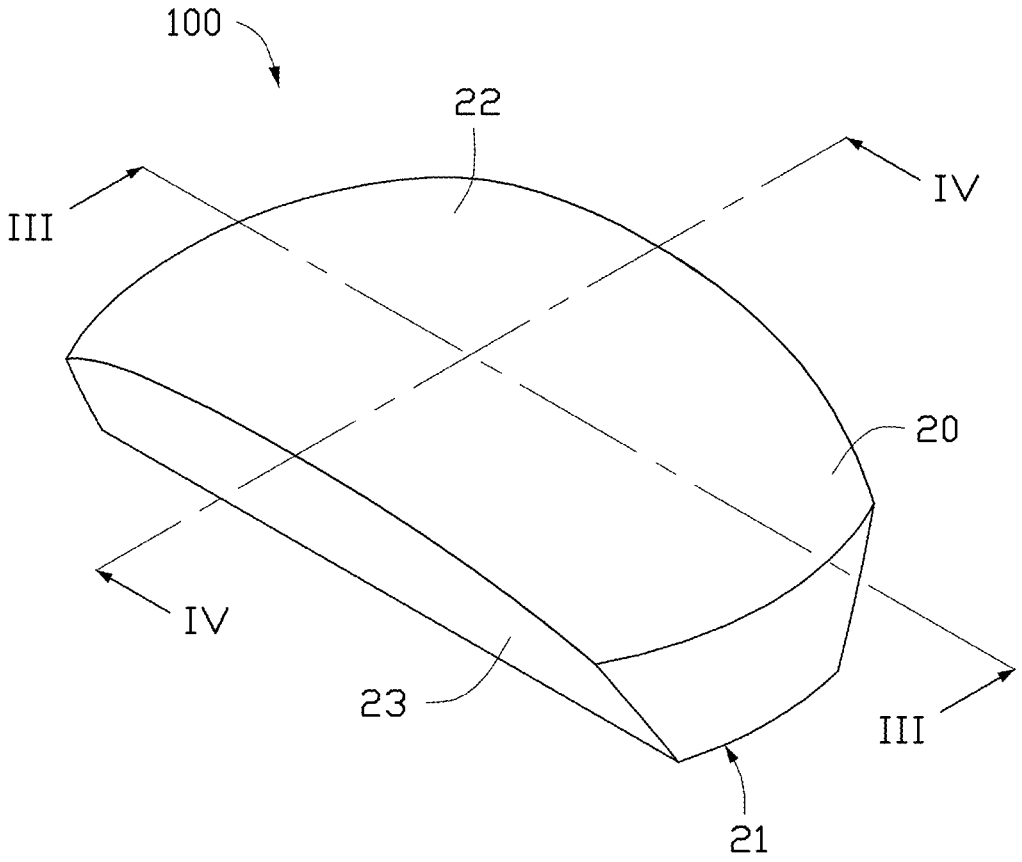
FIG. 1 is a schematic, isometric view of a light source module according to an exemplary embodiment.
Figure 2:
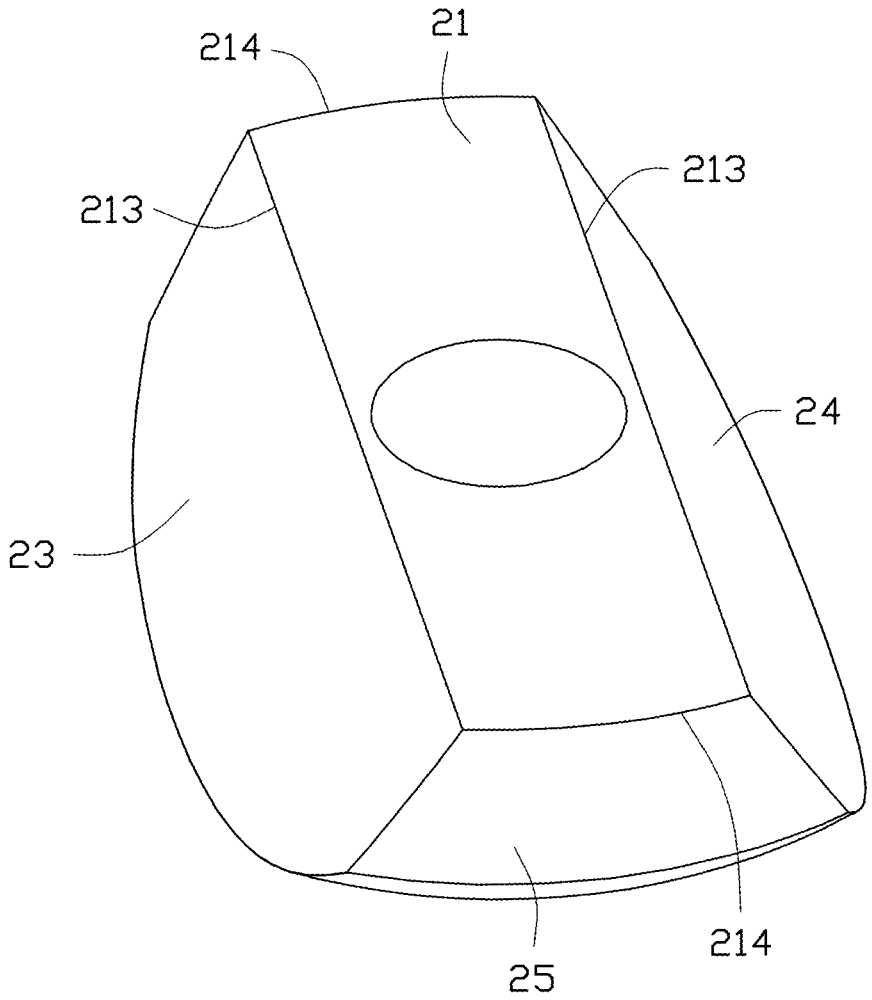
FIG. 2 is an inverted view of a lens of the light source module of FIG. 1.
Figure 3:
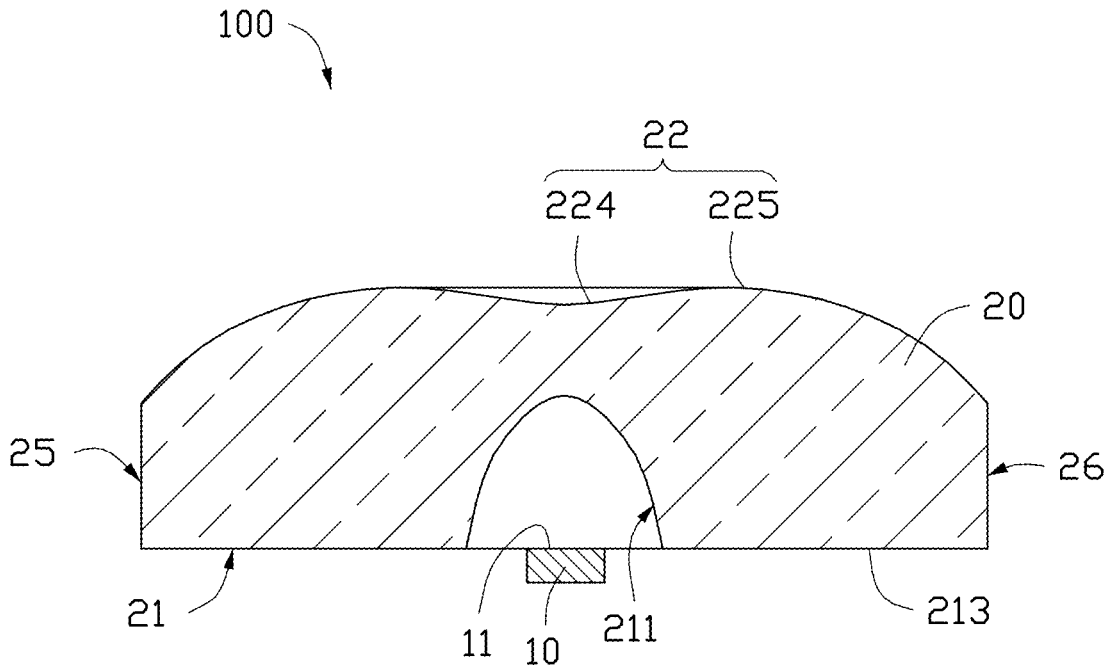
FIG. 3 is a cross-sectional view of the light source module of FIG. 1, taken along line thereof.

Referring to FIGS. 1 to 3, a light source module 100 in accordance with an exemplary embodiment of the present disclosure is illustrated. The light source module 100 includes a light source 10 and a lens 20. Light emitted from the light source module 10 is adjusted by the lens 20.

Figure 4:
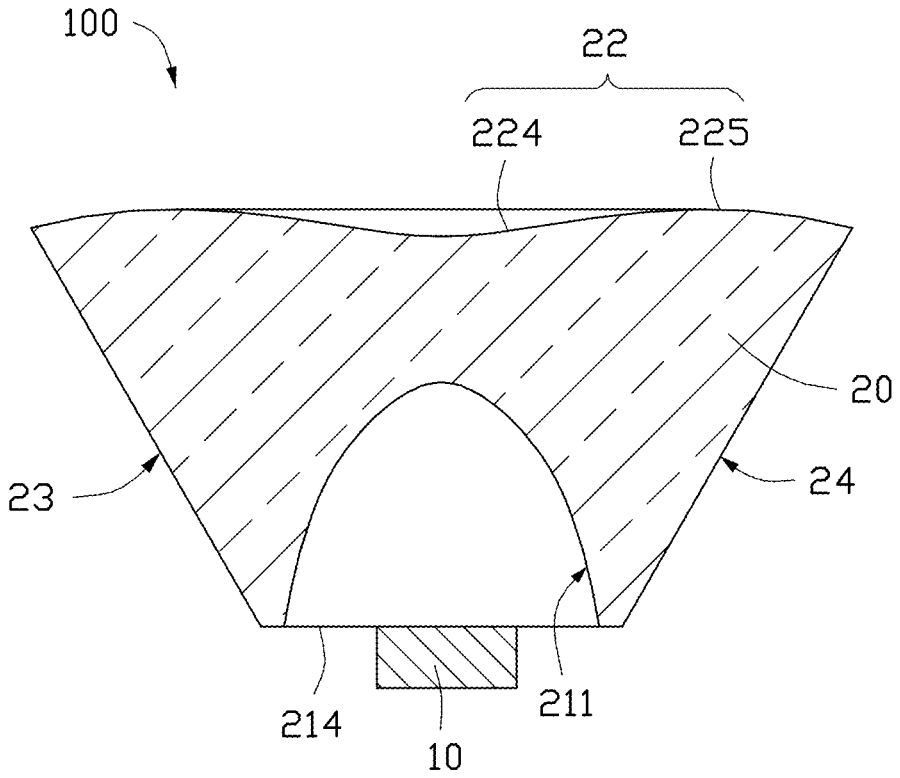
FIG. 4 is a cross-sectional view of the light source module of FIG. 1, taken along line IV-IV thereof.

Referring also to FIGS. 3 and 4, the lens 20 includes a bottom surface 21, a light input surface 211, a light output surface 22, a first side surface 23, a second side surface 24, a third side surface 25 and a fourth side surface 26. The bottom surface 21 is rectangular, and includes two long edges 213 extending along a first direction and two wide edges 214 extending along a second direction perpendicular to the first direction. A length of the lens 20 along the first direction is longer than that of the second direction.

The light input surface 211 is a curved surface depressing from a center of the bottom surface 21 towards the light output surface 22 of the lens 20. The light input surface 211 defines a cavity. In the present embodiment, the axis of the light input surface 211 is coaxial to that of the lens 20. The light input surface 211 is an elliptic sphere surface, and the short axis of the elliptic sphere surface is substantially coplanar with the bottom surface 21, and the long axis of the elliptic sphere surface is perpendicular to the bottom surface 21.

The light output surface 22 is opposite to the bottom surface 21. The output surface 22 includes a concave surface 224 located at a center thereof and a convex surface 225 located at peripheral thereof and surrounding the concave surface 224. The concave surface 224 is just opposite to the light input surface 211 and is depressed towards the light input surface 211 of the lens 20. The concave surface 224 is used for diverging direct light (i.e., light having a small emerging angle) emitted from the light source 10. The convex surface 225 smoothly connects the concave surface 224 and is used for diverging side light (i.e., light having a large emerging angle) emitted from the light source 10.

The first side surface 23, second side surface 24, third side surface 25 and fourth side surface 26 are total reflective surfaces. The first side surface 23 and the second side surface 24 respectively connect the long edges 213 and the light output surface 22. The first side surface 23 and the second side surface 24 are slanting surface, and gradually slant outwardly along a direction from the bottom surface 21 to the light output surface 22. The third side surface 25 and the fourth side surface 26 respectively connect the wide edges 214 and the light output surface 22. The third side surface 25 and the fourth side surface 26 are perpendicular to the bottom surface 21.

The light source 10 faces the light input surface 211 of the lens 20. In the present embodiment, a light emitting surface 211 of the light source 10 is coplanar with the bottom surface 21 of the lens 20. The light source 10 is an LED, and the axis of the LED is coaxial to that of the lens 20. In an alternative embodiment, the light source 10 can be arranged in the cavity defined by the light input surface 211 of the lens 20.

Figure 5:
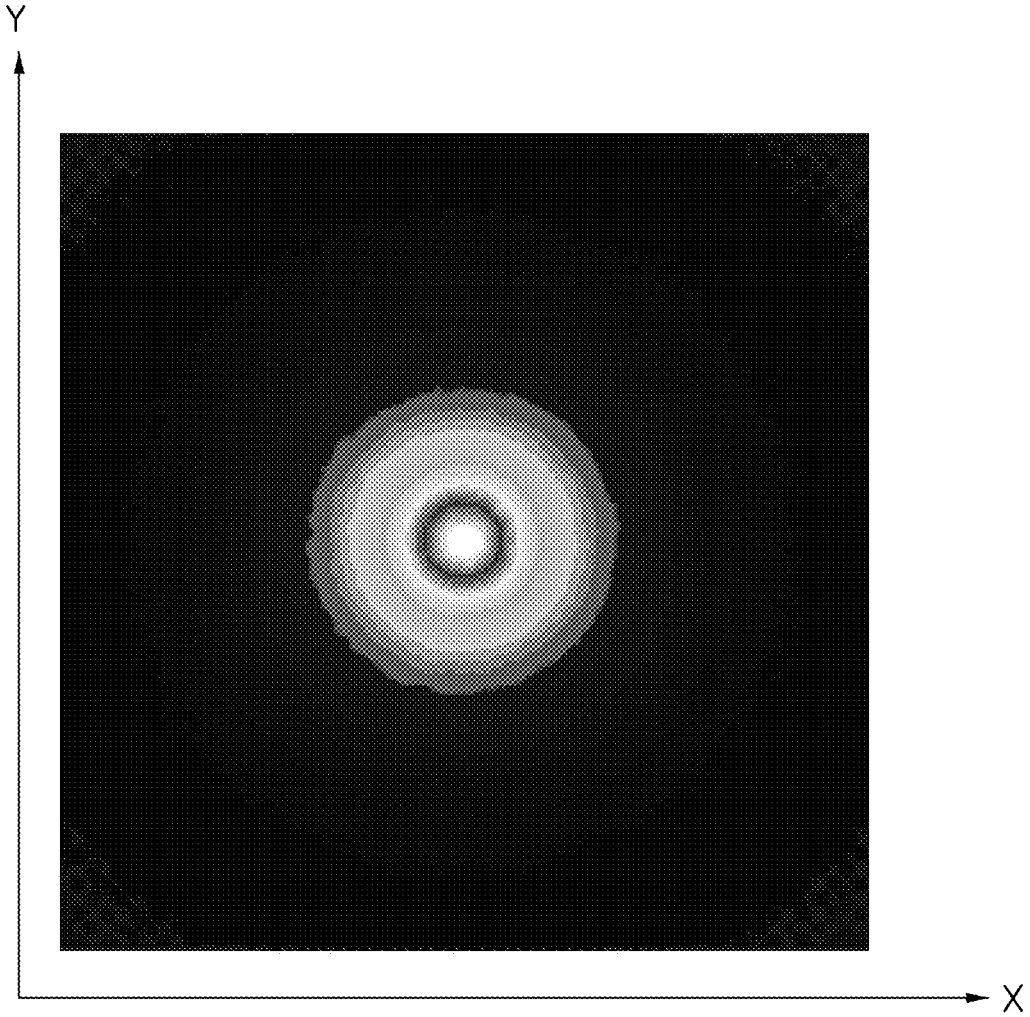
FIG. 5 is a distribution graph of radiation of the light source module of FIG. 1 with a lens being removed.
Figure 6:
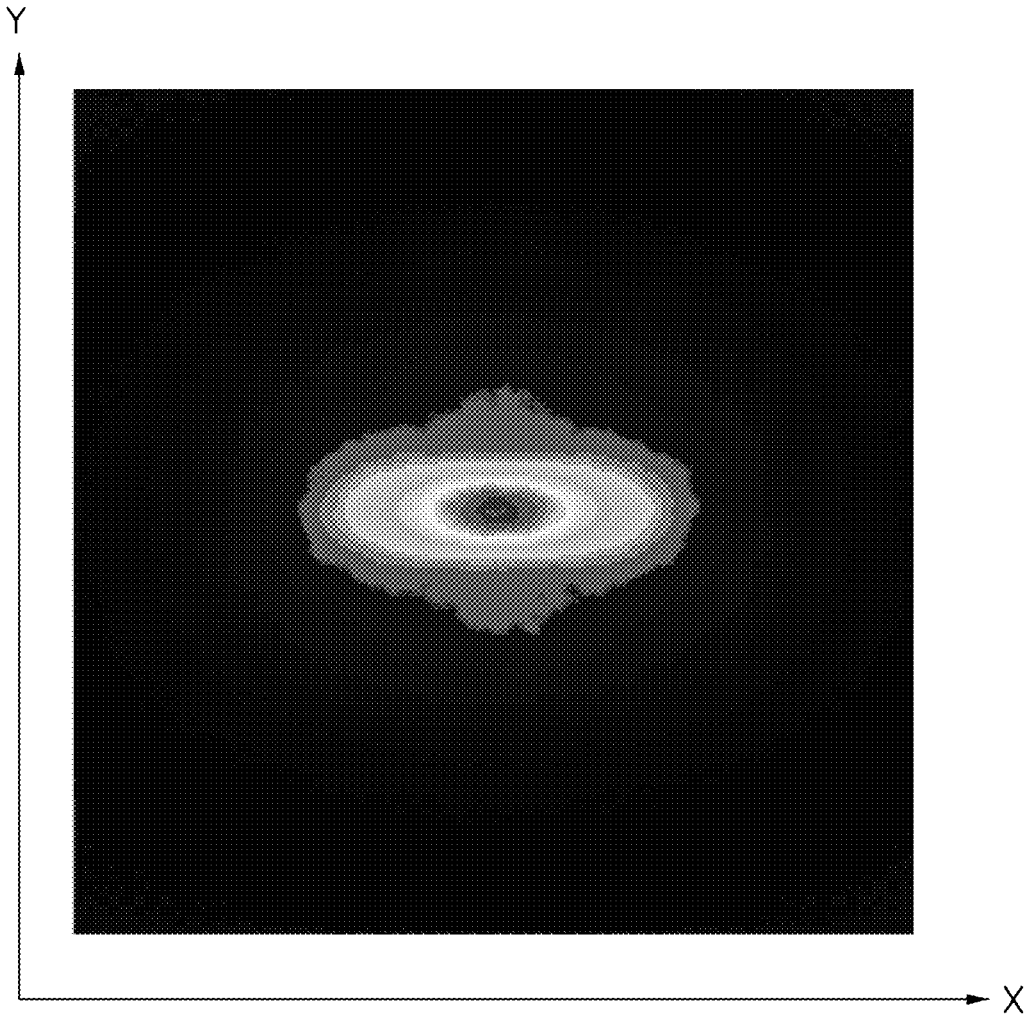
FIG. 6 is a distribution graph of radiation of the light source module of FIG. 1.

Referring to FIGS. 5 and 6, also referring to FIG. 4, parts of light beams emitted from the light source 10 are reflected and converged by the first side surface 23 and the second side surface 24 to the light output surface 22. The converged light beams are refracted and converged by the convex surface 225 of the light output surface 22 to outside. Also referring to FIG. 3, the other parts of light beams emitted from the light source 10 enter the lens 20 and are diverged by the light output surface 22. Therefore, light beams emitted from the light source 10 parallel to the first direction are diverged by the lens 20, and light beams emitted from the light source 10 parallel to the second direction are converged by the lens 20; thus, a distribution of light emission of the light source module 100 is substantially rectangular. When the light source module 100 acts as the light source of a tubular light source module, a plurality of the light source module 100 are arranged in line. Light beams emitted from the light source 10 are diverged by the lens 20, and the radiation angle of the light source module 100 is increased. Therefore, it can reduce the number of the light sources 10, and it is cost down.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A lens comprising:

a bottom surface;

a light input surface depressed from a center of the bottom surface;

a light output surface opposite to the light input surface, the light output surface comprising a concave surface located at a center thereof and a convex surface surrounding the concave surface; and total reflective side surfaces, comprising a first and a second side surfaces extending from two opposite sides of the bottom surface to the light output surface, and a third and a fourth side surfaces extending from the other two opposite sides of the bottom surface to the light output surface, the first and second side surfaces gradually slanting outwardly along a direction from the bottom surface to the light output surface, the third side surface and the fourth side surface being perpendicular to the bottom surface, and the total reflective side surfaces being directly connected between the bottom surface and the light output surface.

2. The lens of claim 1, wherein the bottom surface is rectangular, and the bottom surface comprises two long edges extending along a first direction and two wide edges extending along a second direction perpendicular to the first direction, the first and second side surface connecting the two long edges and the light output surface, and the third and fourth surface connecting the two wide edges and the light output surface.

3. The lens of claim 2, wherein a length of the lens along the first direction is longer than that of the second direction.

4. The lens of claim 1, wherein the light input surface is an elliptic sphere surface.

5. The lens of claim 1, wherein the axis of the light input surface is coaxial to that of the lens.

6. The lens of claim 1, wherein the first and the second side surfaces are directly connected between the third and the fourth side surfaces.

7. A light source module comprising:

a lens comprising:

a bottom surface;

a light input surface depressed from a center of the bottom surface;

a light output surface opposite to the light input surface, the light output surface comprising a concave surface located at a center thereof and a convex surface surrounding the concave surface; and total reflective side surfaces, comprising a first and a second side surfaces extending from two opposite sides of the bottom surface to the light output surface, and a third and a fourth side surfaces extending from the other two opposite sides of the bottom surface to the light output surface, the first and second side surfaces gradually slanting outwardly along a direction from the bottom surface to the light output surface, the third side surface and the fourth side surface being perpendicular to the bottom surface, and the total reflective side surfaces being directly connected between the bottom surface and the light output surface; and a light source facing the light input surface of the lens.

8. The light source module of claim 7, wherein the light source is LED, and the axis of the LED is coaxial to that of the lens.

9. The light source module of claim 7, wherein the bottom surface is rectangular, and comprises two long edges extending along a first direction and two wide edges extending along a second direction perpendicular to the first direction, the first and second side surface connecting the two long edges and the light output surface, and the third and fourth surface connecting the two wide edges and the light output surface.

10. The light source module of claim 9, wherein a length of the lens along the first direction is longer than that of the second direction.

11. The light source module of claim 7, wherein the light input surface is an elliptic sphere surface.

12. The light source module of claim 7, wherein the axis of the light input surface is coaxial to that of the lens.

13. The light source module of claim 7, wherein the first and the second side surfaces are directly connected between the third and the fourth side surfaces.

14. A light source module comprising:

a light source; and a lens comprising:

a bottom surface, the bottom surface being a rectangular and comprising two long edges extending along a first direction and two wide edges extending along a second direction perpendicular to the first direction;

a light input surface facing the light source and depressed from a center of the bottom surface;

a light output surface opposite to the light input surface, the light output surface comprising a concave surface located at a center thereof and a convex surface surrounding the concave surface; and total reflective side surfaces, comprising a first side surface and a second side surface connecting the two long edges and the light output surface, and a third side surface and a fourth side surface connecting the two wide edges and the light output surface, the first and second side surfaces gradually slanting outwardly along a direction from the bottom surface to the light output surface, the third side surface and the fourth side surface being perpendicular to the bottom surface, and the total reflective side surfaces being directly connected between the bottom surface and the light output surface.

15. The light source module of claim 14, wherein a length of the lens along the first direction is longer than that of the second direction.

16. The light source module of claim 14, wherein the light input surface is an elliptic sphere surface.

17. The light source module of claim 14, wherein the axis of the light input surface is coaxial to that of the lens.

18. The light source module of claim 14, wherein the first and the second side surfaces are directly connected between the third and the fourth side surfaces.

* * * * *